US010196192B2

(12) United States Patent
Gum et al.

(10) Patent No.: US 10,196,192 B2
(45) Date of Patent: Feb. 5, 2019

(54) COMPARTMENTED BAG

(71) Applicants: Mark Gum, East Prairie, MO (US); Julia Greaser, Benton, AR (US)

(72) Inventors: Mark Gum, East Prairie, MO (US); Julia Greaser, Benton, AR (US)

(73) Assignee: MONDI JACKSON, INC, Jackson, MO (US)

( * ) Notice: Subject to any disclaimer, the term of this patent is extended or adjusted under 35 U.S.C. 154(b) by 796 days.

(21) Appl. No.: 14/098,795

(22) Filed: Dec. 6, 2013

(65) Prior Publication Data

US 2015/0158635 A1 Jun. 11, 2015

(51) Int. Cl.

*B65D 75/00* (2006.01)
*B65D 75/52* (2006.01)
*B65D 75/58* (2006.01)

(52) U.S. Cl.

CPC ..... *B65D 75/008* (2013.01); *B65D 75/527* (2013.01); *B65D 75/5883* (2013.01)

(58) Field of Classification Search

CPC ..... B65D 31/12; B65D 81/3261; B65D 33/2566; B65D 33/004; B65D 29/00
USPC ..... 383/120, 38–40, 37
See application file for complete search history.

(56) References Cited

U.S. PATENT DOCUMENTS

| | | | | |
|---|---|---|---|---|
| 2,805,814 | A | 9/1957 | Calasibetta | |
| 3,549,451 | A * | 12/1970 | Kugler | 156/275.1 |
| 3,580,486 | A * | 5/1971 | Kugler | 383/8 |
| 4,164,170 | A * | 8/1979 | Nordin | 493/194 |
| 4,696,403 | A * | 9/1987 | Hoover | 383/37 |
| 4,807,754 | A * | 2/1989 | Rowe | 206/390 |
| 4,872,766 | A * | 10/1989 | Dancy | 383/10 |
| 5,669,504 | A * | 9/1997 | Leone et al. | 206/554 |
| 5,924,573 | A * | 7/1999 | Piraneo et al. | 206/554 |
| 6,409,386 | B1 * | 6/2002 | Trani | B65D 75/008 383/104 |
| 6,669,615 | B2 * | 12/2003 | DeMatteis | 493/194 |
| 7,153,026 | B2 * | 12/2006 | Galomb | 383/122 |
| 7,331,917 | B2 | 2/2008 | Totani | |
| 2009/0142006 | A1 * | 6/2009 | Wine et al. | 383/38 |

FOREIGN PATENT DOCUMENTS

| | | |
|---|---|---|
| DE | 9006144 U | 9/1990 |
| GB | 937956 A | 9/1963 |

* cited by examiner

*Primary Examiner* — Peter Helvey
(74) *Attorney, Agent, or Firm* — Andrew Wilford

(57) ABSTRACT

A compartmented bag with at least two pouches that can be separated along a tear line. Each pouch has front and back panels and a standing base formed of a base gusset panel constituted of a separate piece of film that is fastened by welds to the front and back panels.

13 Claims, 3 Drawing Sheets

COMPARTMENTED BAG

FIELD OF THE INVENTION

The present invention relates to a bag. More particularly this invention concerns a bag made of plastic film and with at least two compartments that can be separated from each other.

BACKGROUND OF THE INVENTION

Different manufacturing processes are known in the production of film bags. With a form-fill-and-seal method (FFS), a bag film is formed into a tube that is converted directly into individual bags that are filled and sealed.

Further known are prefabricated film bags that are manufactured in different ways. Correspondingly, the entire film bag can be formed from a single strip of film by folding and welding.

The present invention, however, relates particularly to film bags that are manufactured by a transverse method, and where the front and back panels are formed of separate sections of film.

U.S. Pat. No. 7,331,917 describes a method of making film bags where a bag strand is formed in such a manner that consecutive film bags are juxtaposed next to each other at longitudinal edges of the bags. The production direction therefore corresponds to a transverse direction with respect to the individual bags. EP 1 541 332 discloses that a bag strand is formed in a first step with consecutive bag blanks that are still connected to each other during production. A first strip of film is supplied in the production direction. A piece of film is then added, and the edges of the piece of film are folded over onto a center section. The edges are usually of equal width leaving a gap between the two edges after the folding step.

Subsequently, pieces of the film are laid evenly spaced transversely relative to the production direction, meaning along the longitudinal direction of the bag, onto the first strip of film prior to a second strip of film being added in the production direction, and the first strip of film and the pieces of the film are covered up. Longitudinal welds are then created transversely relative to the production direction to weld the piece of films, on the one hand, to the folded over edges on the second strip of film and, on the other hand, on the opposite side thereof, to the first strip of film.

Finally, individual film bags are separated from the correspondingly formed bag strand by cutting at the piece of film in such a manner that one folded piece of film forms two folds of consecutive film bags. Film bags thus formed have a single compartment forming a pouch.

U.S. Pat. No. 2,805,814 discloses a compartmented bag that can be formed from a continuous strip of film. The edges of the strip of film can be folded over, and two longitudinal welds are formed at the overlap. The two pouches can optionally each have a side gusset panel. The compartmented bags suffer from the disadvantage that they are hard to handle. In particular, the two individual pouches cannot be stood up.

Another compartmented bag is known from DE 90 006 144, where the compartmented bag is constituted only of a front and a rear panel. A separation of the two pouches is not easily possible, and handling is generally difficult.

GB 937,956 discloses a method of making a string of bags that allows for tearing off individual bags. When the bag film is folded onto itself, a strand of bags can be formed that are adjacent to each other. However, if two webs of material are welded together, it is possible for open bags to be formed in succession, one behind the other as well as one next to the other.

OBJECTS OF THE INVENTION

It is therefore an object of the present invention to provide an improved method of making a compartmented bag of plastic film.

Another object is the provision of such an improved method of making a compartmented bag of plastic film, that overcomes the above-given disadvantages, in particular that is characterized by especially easy handling.

SUMMARY OF THE INVENTION

The object of the invention is attained by a compartmented bag with at least two pouches that can be separated from each other along a tear line, having at least front and back panels, and where each pouch has a standing base that is formed by a separate base gusset panel formed a separate piece of film and fastened to the front and back walls by welds.

The described compartmented bag is preferably formed of two strips of films for the front and back panels that are opposite each other, where, however, a piece of film is inserted between the front and back panels as a base gusset panel. Furthermore, individual compartmented bags are separated in such a manner from a strip that each compartmented bag has at least two pouches.

To allow for an easy separation, a tear line is provided between the two pouches. The tear line can be a weakening of the bag material or, preferably, a perforation that can be formed mechanically and/or by a laser.

In the context of the present invention, the front and back panels can be connected to each other directly on the two longitudinal edges of a pouch, such that the interior of the pouch is only formed by the front and back panels and the base gusset panel, the base gusset panel allowing pouches that are separated from each other to be stood up.

According to a preferred embodiment of the invention, it can be provided, however, that the front and back panels are directly connected to each other by a longitudinal weld on the pouches along the tear line and above the base gusset panel, a side gusset panel being between the front and back panels at the bag's edge opposite the tear line. Seen individually, the two pouches each have an asymmetrical structural design with a side gusset panel only on one edge of the bag.

Forming a side gusset panel is advantageous for several reasons in the context of the present invention. First, providing a side gusset panel can help to substantially increase the filling capacity of the individual pouches, and moreover the stability when standing of the individual pouches is improved as well because the side gusset panel spreads the front and back panels apart. The front and back panels are connected to each other at the tear line directly above the base gusset panel, such that only the front and back panels must be torn there.

It is basically also conceivable in the context of the invention to provide for separation at the side gusset panels, in which case it would be necessary for the initially still interconnected side gusset panels of neighboring pouches to be torn as well as the front and back panels.

While each pouch, when taken by itself, is asymmetrical according to the described preferred embodiment with exactly one side gusset panel for each pouch, a preferred embodiment of the present invention provides for a mirror-symmetrical structural design of the compartmented bag overall with respect to the tear line. This way, it is possible to provide dual-pouches that can receive either two equally large portions of the same product or two different products, wherein, however, the properties of the pouches correspond to each other otherwise.

It is understood that the mirror-symmetrical structural design refers to the structure of the compartmented bag. Particularly when different products are accommodated inside the pouches, it is advantageous to provide for different outward appearances.

If the pouches each have at least one side gusset panel, these side gusset panels can end at a spacing from the top edge of the pouches. This simplifies tearing open the pouches at the top edge thereof or the provision of a resealable closure.

The pouches can each have a resealable closure. Suitable are, for example, screwed closures, Velcro closures, zipper closures or slider closures. Finally, a closure that is provided by a permanent adhesive is also conceivable.

As explained above, the compartmented bag can be used for portions of the same product or for different products. In particular, the compartmented bag can be used for food products, animal feed, hygiene or construction products.

For example, a compartmented bag can contain various sauces, snacks, cereals, salad toppings, frozen fruit, liquids, or the like. Especially advantageously, it is possible to provide different products that are complementary and/or that should not be mixed together until immediately prior to use. The compartmented bag can contain, for example, vinegar and oil, hair shampoo and conditioner, ketchup and mustard, cat food and dog food, mixed beverages, different baking ingredients, two-component adhesives or construction products, or the like.

Regarding animal feed, it is possible, for example, to provide different flavors inside the compartmented bag to offer a larger selection for pets. Moreover, a single compartmented bag can also contain products for different animals, for example for cats and dogs.

To further simplify the handling properties of the compartmented bag, it is possible to provide a notch at the tear line at the top edge of the pouches and/or at the bottom edge of the pouches. Notches at the top edge, on the one hand, and on the bottom edge, on the other hand, are provided for various purposes. A cutout at the top edge of the pouches can form a type of notch for starting a tear in order to simplify separation of the at least two adjacently disposed pouches. Correspondingly, a cutout of this type is usually quite small and has a width typically less than 10%, preferably less than 5%, of the total width of the compartmented bag.

A cutout at the bottom edge of the pouch extends usually also into the base gusset panel there. The cutout is correspondingly provided to allow for the possibility of an even, reliable standing position on the base gusset panel, when the pouch is raised. Therefore, the base cutout is preferably configured as wider than the cutout at the top edge of the pouches. Correspondingly, the width of the cutout on the bottom edge of the pouches is more than 5%, preferably more than 10% of the total width of the compartmented bag.

As a matter of fact, the compartmented bag can also be provided with at least one carry handle. A single carry handle is basically sufficient for carrying the entire compartmented bag as a single unit.

However, according a preferred embodiment of the invention, each pouch has a separate carry handle that must be fastened at a suitable location. If the pouch can include, according to one preferred embodiment of the invention, at least one side gusset panel, the carry handle can be disposed on the side gusset panel. The individual pouches can be especially easily handled with the aid of the carry handle, in that after dispensing the often liquid, powdery or granular product, the carry handle can be used for exactly dosing the product.

The compartmented bag is usually constituted of a multilayer film that can be coextruded as well as laminated. Especially preferred are multilayered laminated films that can also be imprinted on the inside. The front and back panels, the piece of film for the base gusset panel and the optionally provided side gusset panels can be constituted of the same material, or at least of similar films.

On the inner surface of the bag, the film preferably has a layer that can be welded, and on the outer surface side of the bag, a layer is provided that only melts at a higher temperature or not at all, such that the outer layer is not compromised during manufacture of the compartmented bag and the application of the necessary welding temperature. For example, multilayer laminated films are suitable that include a weldable layer made of a polyolefin with a low melting point, particularly polyethylene. The outer layer on the opposite side, which forms the outer surface of the compartmented bag, can be, for example, polyethylene terephthalate (PET), oriented polyamide (OPA) or a biaxially oriented polypropylene (BO-PP). Moreover, to improve the barrier effect, it is also possible to provide an inner metal film or a metallized plastic film layer. The weldable polyolefin usually has a layer thickness of between 50 and 150 μm, while the other layers are configured as thinner, for example having a layer thickness of between 9 and 30 μm.

The compartmented bags are preferably manufactured in a transverse process in which a first strip of film is supplied to the production means in order to form the front or back panel of the pouches, pieces of films that are folded onto themselves being placed at an even spacing onto the first strip of film to form the side gusset panels crosswise relative to the direction of production, and where a resealable closure is optionally placed thereon, a separate piece of film is supplied as a base gusset panel, and a second strip of film is finally supplied and placed on the first strip of film, the base gusset panel, optionally, the resealable closure and the side gusset panels.

To form the longitudinal edges of the pouch, welds are created transversely relative to the direction of manufacture not only on the edge of the compartmented bag but also at the tear line that separates the pouches from each other. The tear line can be especially easily formed by a perforation generated by a stamping or a laser process.

To be able to separate individual pouches from each other, the tear line extends at least along the longitudinal weld, transversely relative to the direction of production.

However, it is basically also possible to create a weld in the center of the first strip of film and second strip of film, where a second tear line is formed. Two strips must then be supplied as base gusset panels in order to generate, according to a variant of the present invention, a compartmented bag with four pouches that can be separated from each other at a first tear line and a second tear line, the first tear line extending along longitudinal edges of the pouches and the second tear line separating the pouches in such a manner that, in the individual pouches, the second tear line is opposite the respective base gusset panel, meaning at the upper ends of the pouches.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
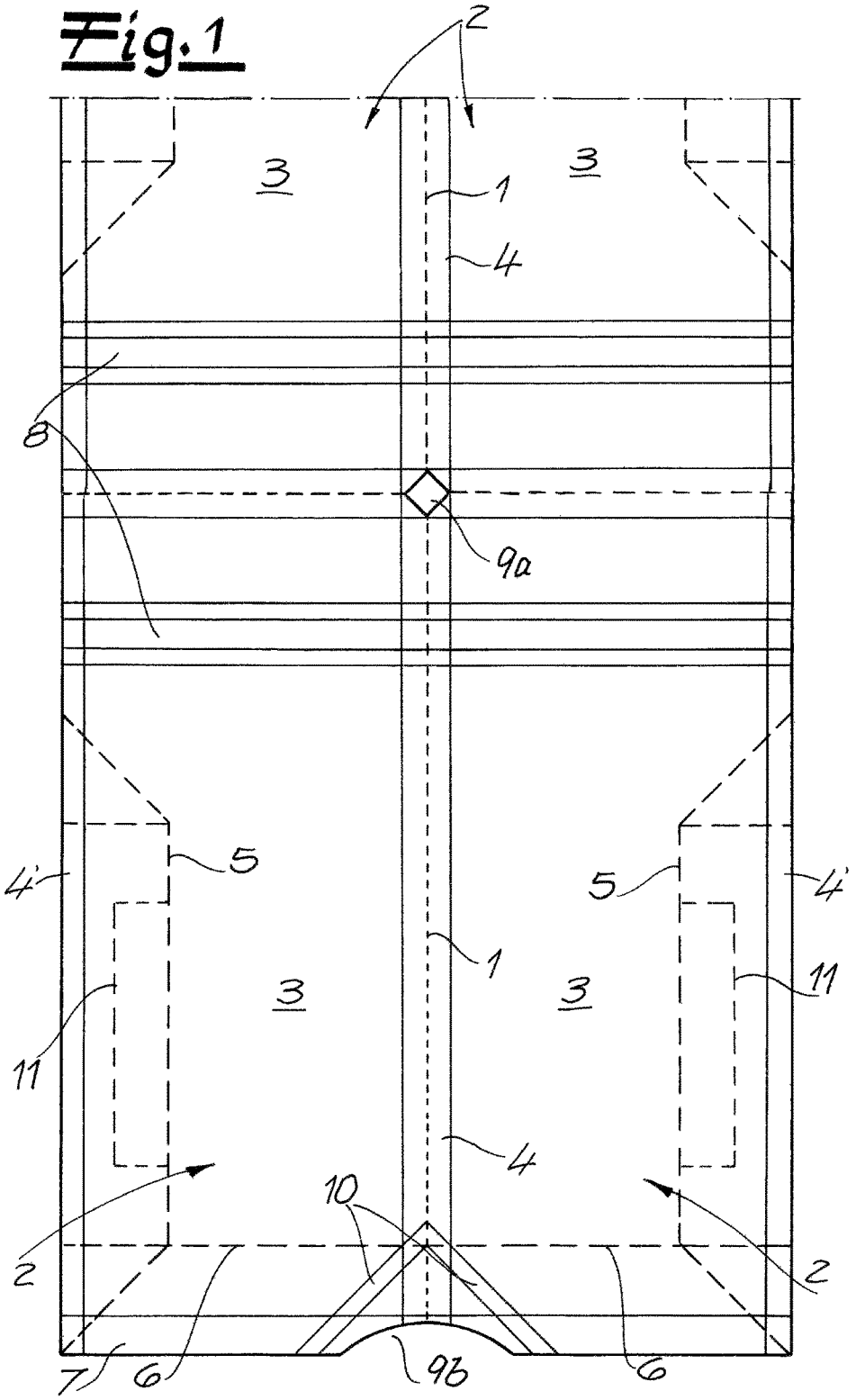
FIG. 1 is a schematic view of a compartmented bag during manufacture.

As seen in FIG. a compartmented bag has two pouches 2 that can be separated from each other along a tear line 1 and that each have a front and a back panel 3. The tear line 1 is a perforation row that extends along a wide longitudinal weld 4 extending longitudinally centrally between the pouches 2, such that, starting from the tear line 1, mirror symmetry of the compartmented bag results. The individual pouches 2, on the other hand, are not themselves symmetrical. While the front and back panels 3 are directly connected to each other at their inner side edges on the tear line 1 by the wide longitudinal seam 4, on the opposite longitudinal side of the pouch 2, there is a side gusset panel 5 between outer side edges of the front and back panels 3 and connected to the front and back panels 3 by longitudinal welds 4'.

According to the invention, each pouch 3 has at a lower end a base gusset panel 6 that is provided as the standing base after the compartmented bag has been filled and that is constituted of a separate piece of film. The piece of film of the base gusset panel 6 is fastened to the front and back panels 3 by transverse welds 7.

Figure 2:
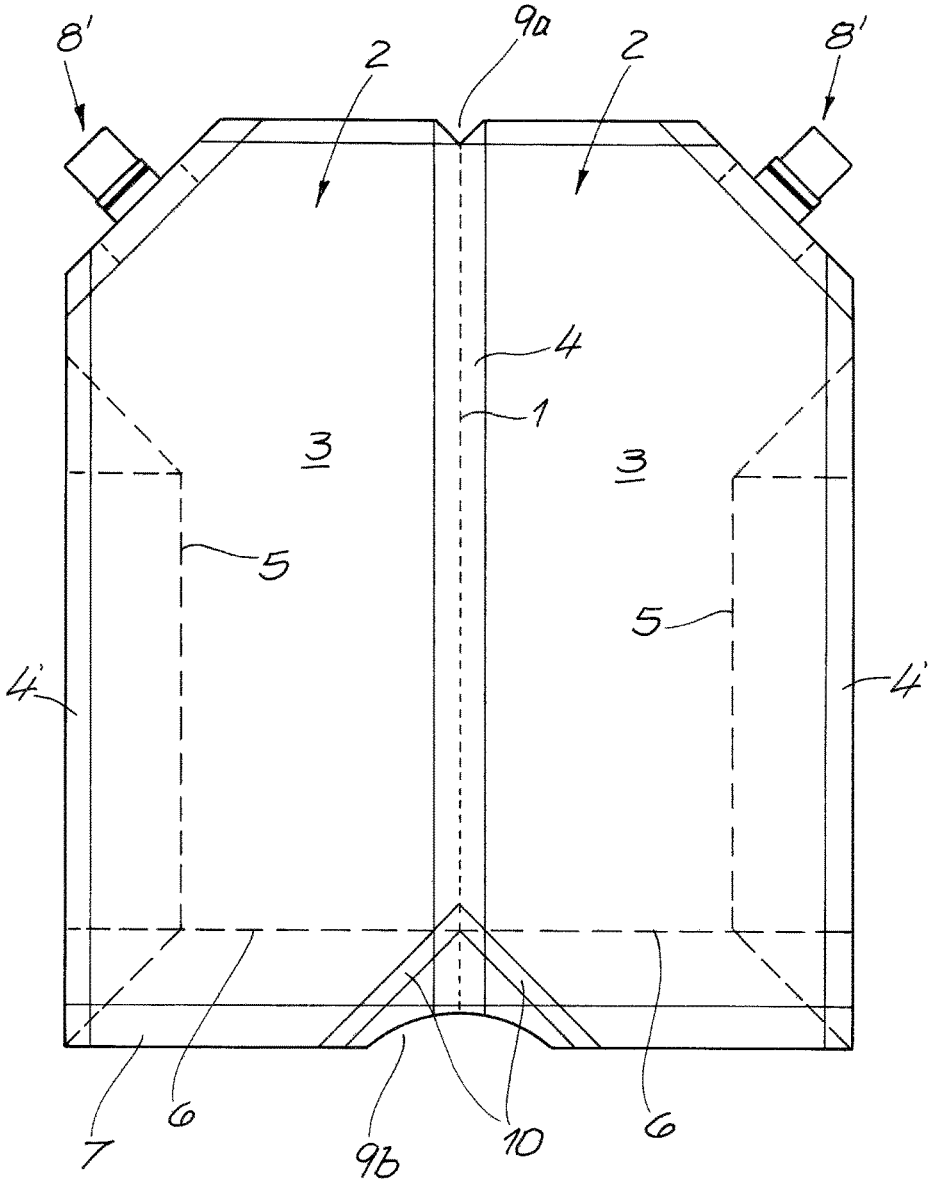
FIG. 2 is a view of an alternate configuration of the compartmented bag.

To further illustrate the structural design of the compartmented bag, FIGS. 1 and 2 show the bag in an unfilled, flat condition. In fact, the compartmented bag can be initially manufactured as a premade bag and then filled, in which case the two pouches 2 can receive respective portions of the same product or of different products.

In the embodiment according to FIG. 1, the side gusset panels 5 end below a top edge of the pouches 2. This way, it is especially easy to tear the pouch 2 open in a top region and/or to provide it with a resealable closure 8, 8'. Correspondingly, FIG. 1 shows a resealable closure 8 in the form of a self-locking Velcro closure that can be supplied especially easily as a continuous strip during manufacture.

In the alternative, the resealable closure can also include textured strips that can be interlocked like a zipper closure, and, finally, resealing by means of a permanent adhesive is conceivable as well.

The resealable closure 8 formed by a self-locking Velcro closure is especially useful for holding particulate products such as, for example, animal feed, cereal, or the like.

The compartmented bag has at the tear line 1, on the top edge of the pouches 2 as well as on the bottom edge of the pouches 2, notches 9*a*, 9*b*. The notches 9*a*, 9*b* can be created, for example, by stamping.

The notch 9*a* on the top edge of the pouches 2 is quite narrow and intended to facilitate tearing open of the bag. It is possible for the notch 9*a* to have a U- or V-type shape for this purpose.

The notch 9*a* on the top edge of the pouch 2 correspondingly has a width of less than 5% of the total width of the compartmented bag.

The notch 9*b* on the bottom edge of the pouches 2, on the other hand, serves in combination with the base gusset panel 6 for the formation of the standing base. The notch 9*b* on the bottom edge of the pouches 2 ensures that the individual filled pouches 2 are safely and evenly supported over a large area, while connected as well as after having been separated from each other. Slanted weld sections are also advantageously provided at the bottom notch 9*b*.

Further optional embodiments of the compartmented bag are indicated in FIG. 1. For example, it is possible to provide a carry handle loop 11 on each of the side gusset panels 5 as shown by a dashed line. Moreover, it is also possible to provide a compartmented bag that has not only two but four pouches 2 that can be separated from each other. This is particularly easily achieved by providing for two further pouches 2 that are disposed mirror-symmetrically on the top edge of the two shown pouches 2.

FIG. 2 shows an alternate configuration of the compartmented bag that differs in the type of resealable closure 8, 8'. Instead of a resealable closure 8 in form of a Velcro closure, the resealable closure 8' is provided in form of a capped spout, and one such spout 8' is provided in a corner of each of the pouches 2 between the respective outer side edge and the respective top edge.

Figure 3:
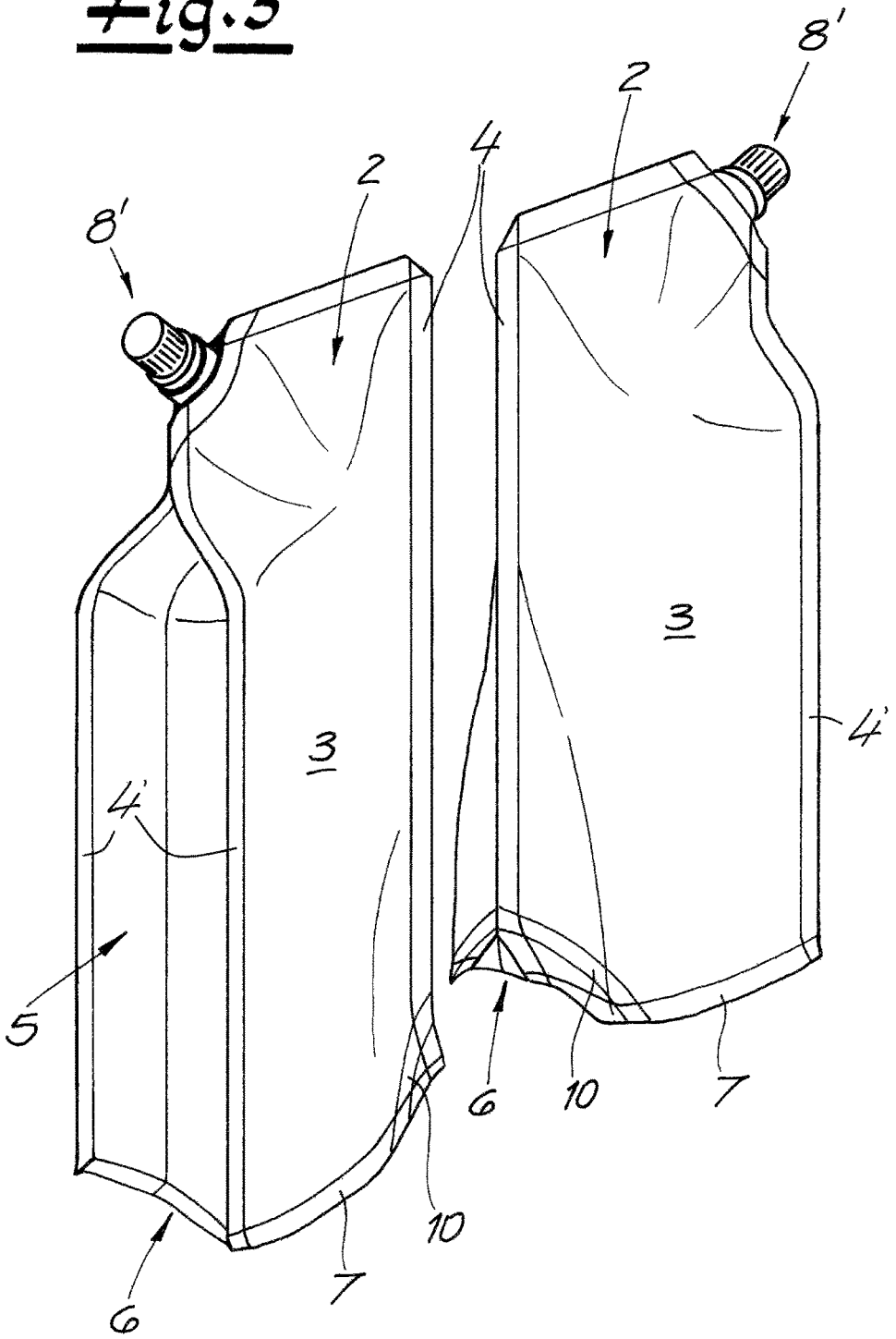
FIG. 3 is a view of pouches as in FIG. 2 but that are separated from each other and stood on their bases.

FIG. 3 finally shows the filled pouches 2 from FIG. 2, after they have been separated from each other. Both pouches 2 can be placed on the standing base that is formed by the base gusset panel 6 and handled separately from each other.

We claim:

1. A compartmented bag with at least two pouches that can be separated along a tear line, each pouch having:

front and back panels;

a standing base formed of a base gusset panel;

a longitudinal weld directly connecting the front and back panels of the pouches to each other along the tear line above the base gusset panel; and side gusset panels between the front and back panels at bag edges opposite the tear line, the front and back panels along with the base gusset panels and the side gusset panels being constituted of separate pieces of film with the side gusset panels and base gusset panels being fastened by welds to the front and back panels, the side gusset panels ending at a spacing from top edges of the pouches.

2. The compartmented bag defined in claim 1, wherein the two pouches have a mirror-symmetrical structural design with respect to the tear line.

3. The compartmented bag defined in claim 1, wherein the pouches each have a resealable closure.

4. The compartmented bag defined in claim 1, wherein respective top and/or bottom notches are provided at top edges and/or bottom edges of the pouches at the tear line.

5. The compartmented bag defined in claim 4, wherein a notch provided at the top edge of the pouches has a width of less than 10% of the total width of the compartmented bag.

6. The compartmented bag defined in claim 1, wherein at least one of the pouches has a carry handle.

7. The compartmented bag defined in claim 6, wherein each pouch has a carry handle on the respective side gusset panel.

8. The compartmented bag defined in claim 1, wherein the front and back panels are each formed of a respective piece of multilayer laminated film.

9. The compartmented bag defined in claim 1 with four pouches, wherein the pouches can be separated from each other at a first tear line and at a second tear line, the first tear line extending along the longitudinal edges of the pouches, the second tear line separating the pouches in such a manner that the second tear line is on the individual pouches opposite the respective base gusset panel.

10. The compartmented bag defined in claim 1, further comprising:

respective first and second pour spouts on the pouches at a corner formed between the respective outer side edges and the respective top edges.

11. The compartmented bag defined in claim 1, further comprising:

first and second handle loops attach centrally to the outer side-gusset panels.

12. A compartmented bag with at least two pouches that can be separated along a tear line, each pouch having:

front and back panels;

a standing base formed of a base gusset panel;

a longitudinal weld directly connecting the front and back panels of the pouches to each other along the tear line above the base gusset panel; and side gusset panels between the front and back panels at bag edges opposite the tear line, the front and back panels along with the base gusset panels and the side gusset panels being constituted of separate pieces of film with the side gusset panels and base gusset panels being fastened by welds to the front and back panels, the side gusset panels being provided at bottom edges of the pouches at the tear line with a notch having a width of more than 5% of the total width of the compartmented bag.

13. The compartmented bag defined in claim 12, wherein the side gusset panels end at a spacing from top edges of the pouches.

* * * * *